United States Patent [19]

Kawashima

[11] Patent Number: 4,525,612

[45] Date of Patent: Jun. 25, 1985

[54] GAS INSULATED SWITCH

[75] Inventor: Kazue Kawashima, Tokyo, Japan

[73] Assignee: Tokyo Shibaura Denki Kabushiki Kaisha, Kawasaki, Japan

[21] Appl. No.: 497,716

[22] Filed: May 24, 1983

[30] Foreign Application Priority Data

May 24, 1982 [JP] Japan ..... 57/87428

[51] Int. Cl.[3] ..... H01H 33/18

[52] U.S. Cl. ..... 200/147 R; 200/148 B; 335/195

[58] Field of Search ..... 200/147 R, 148 B; 335/195

[56] References Cited

U.S. PATENT DOCUMENTS

| | | | |
|---|---|---|---|
| 4,032,736 | 6/1977 | Ruffieux et al. | 200/147 R |
| 4,410,778 | 10/1983 | Weston | 200/147 R |
| 4,414,450 | 11/1983 | Moll et al. | 200/147 R |

OTHER PUBLICATIONS

"About the SF6 Gas Circuit Breaker of rated 3.6/7.2 kV" Ref. 1, Japan Electric Commity published on 1970, Ono Shunichiro Fujiwara Kazushi et al., (Yasukawa Electric Works).

"Arc Behavior & Breaking Characteristic of SF6 Gas Circuit Breaker of Rotary Arc Extinguishing System: Japan Electric Commity published on 1981 Ref. 2, Fujiwara Kazushi et al., (Yasukawa Electric Works).

*Primary Examiner*—Robert S. Macon

*Attorney, Agent, or Firm*—Oblon, Fisher, Spivak, McClelland & Maier

[57] ABSTRACT

A gas insulated switch including a tank filled with an insulating gas, wherein fixed and moving main current carrying contactors are positioned opposite each other, each including respectively fixed and moving arc electrodes installed therein and extending therefrom towards each other. According to a preferred embodiment, the fixed arc electrode includes an arc-proof end piece mounted adjacent and electrically connected to one end of an electric coil and an end ring mounted adjacent and electrically connected to the other end of the electric coil. During operation, upon opening and closing of the electrical connection between the fixed and moving arc electrodes, an arc is generated therebetween and a resultant current flows through the coil to generate a magnetic field. The magnetic field produces a force on the arc tending to rotate the arc circumferentially, whereby the arc is extinguished.

3 Claims, 6 Drawing Figures

GAS INSULATED SWITCH

BACKGROUND OF THE INVENTION

1. Field of the Invention

This invention relates to a gas insulated switch which opens and closes within a vessel filled with arc-extinguishing gas (e.g. $SF_6$), for switching an electric current below a rated load of a system.

2. Description of the Prior Art

In recent years the need for the simplification and economic utilization of switchgear in electric power systems has led to a requirement that isolators also have a load current switching capability.

In the conventional switching circuit illustrated in FIG. 1, the power-source side P and load-side L of two sets of bus-bar lines A and B are connected in common, and one system can be cut off by forming a loop through the switches $C_a$ and $C_b$.

In this case, parallel-break contacts are used for the switches $C_a$ and $C_b$; but in some cases, when these switches do not provide sufficient circuit-breaking capability, the latter is increased by the adoption of gas-puffer type contacts.

However, the gas-puffer type of switch itself requires considerable power to operate it, and its construction is complicated, so that it is uneconomic when only a small breaking capacity is required.

SUMMARY OF THE INVENTION

Accordingly, the objects of this invention are to provide a new and improved a gas-insulated switch of the type in which an arc between the contacts is extinguished by rotation caused by a magnetic field, which is of simple construction, which has a high current-breaking capability, and which suffers no diminution of this capability even after the passage of a large amount of current.

These and other objects are achieved according to the invention by providing a new and improved gas-insulated switch including a first contact part having a ring-shaped arc-proof piece and a coil disposed in close proximity to each other, an arc electrode disposed therebetween and connected to the coil, a main current-carrying contactor on the outside of the arc electrode, and a second contact part having a main current-carrying contactor which makes contact with or separates from the main current-carrying contact and an arc electrode which makes contact with or separates from the arc electrode; and in which, by the bringing into contact or separating of these two contact parts, the route for the electric current is opened or closed, so that when the circuit is open, an arc is generated between the arc electrode and the ring-shaped arc-proof piece, and when this occurs, the arc is rotated by the magnetic flux produced in the coil by the current flowing to it, and the current is thus broken, and when the circuit between the contact parts is closed, the arc electrode in the second contact part makes contact with the coil in the first contact part, thus isolating the coil electrically.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
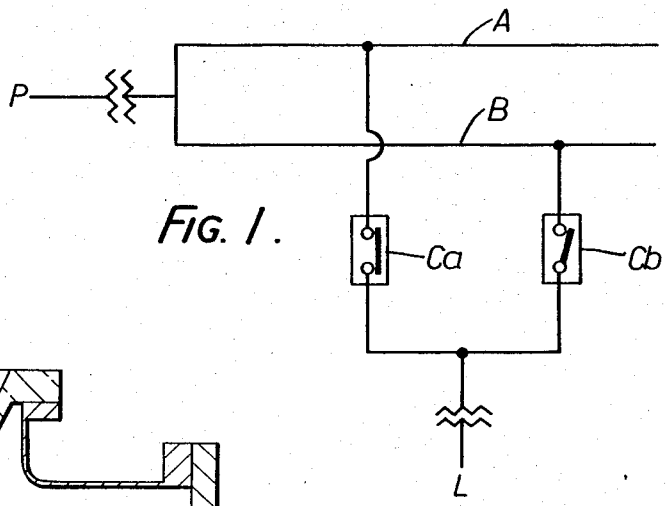
FIG. 1 is a circuit diagram of an example of a loop current switching circuit.
Figure 2:
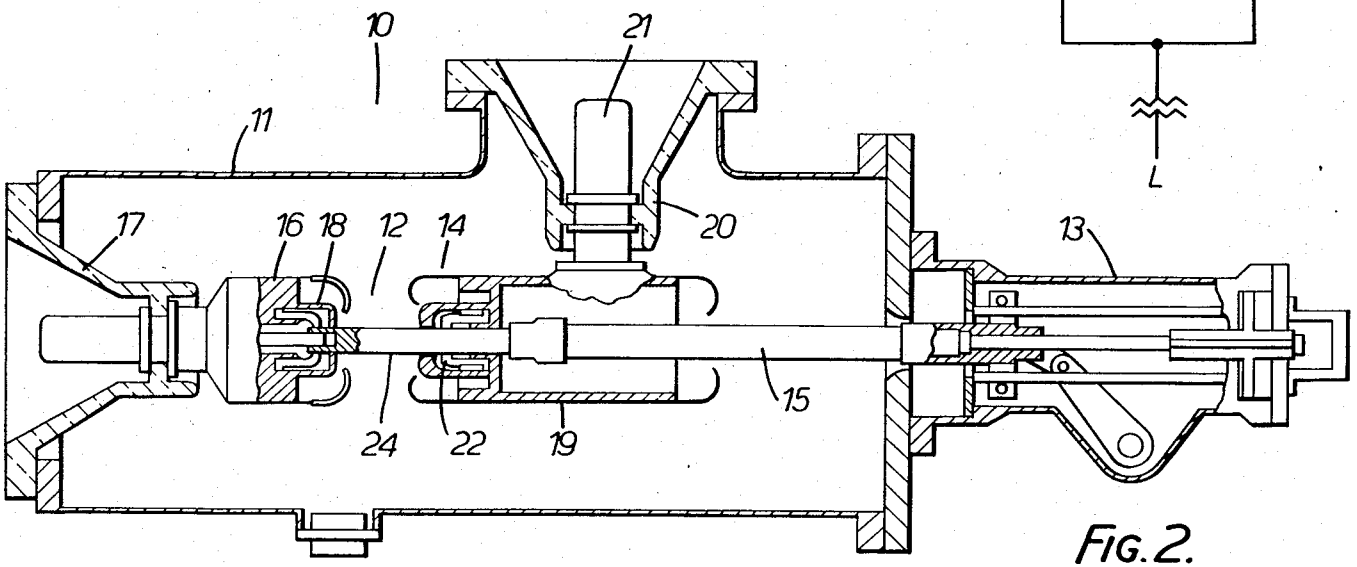
FIG. 2 is a longitudinal cross-sectional view of a gas-insulated switch according to the present invention.

Referring now to the drawings, wherein like reference numerals designate identical or corresponding parts throughout the several views, the disconnecting switch shown in FIG. 1 will be explained in detail with reference to FIG. 2.

The gas-insulated disconnecting switch 10 includes a grounded tank 11 containing a disconnecting section 12 and filled with an insulating gas, and an operating mechanism 13 which controls a movable contact 14 through an operating rod 15.

The disconnecting section 12 includes a fixed contact 16 and the movable contact part 14 which is attachable to and detachable from the fixed contact part 16. The fixed contact part 16 is supported by the insulating spacer 17. A plurality of resilient fingers 18 is arranged on top of the fixed contact 16, i.e. at the axial end of contact 16 facing contact 14. A conductor tube 19 is supported by the insulating spacer 20 and is connected to the terminal 21. A plurality of resilient fingers 22 is arranged on top of the conductor tube 19. The movable contact 14 has the shape of a tube and is accommodated in the conductor tube 19 and can be moved to and from.

Figure 3:
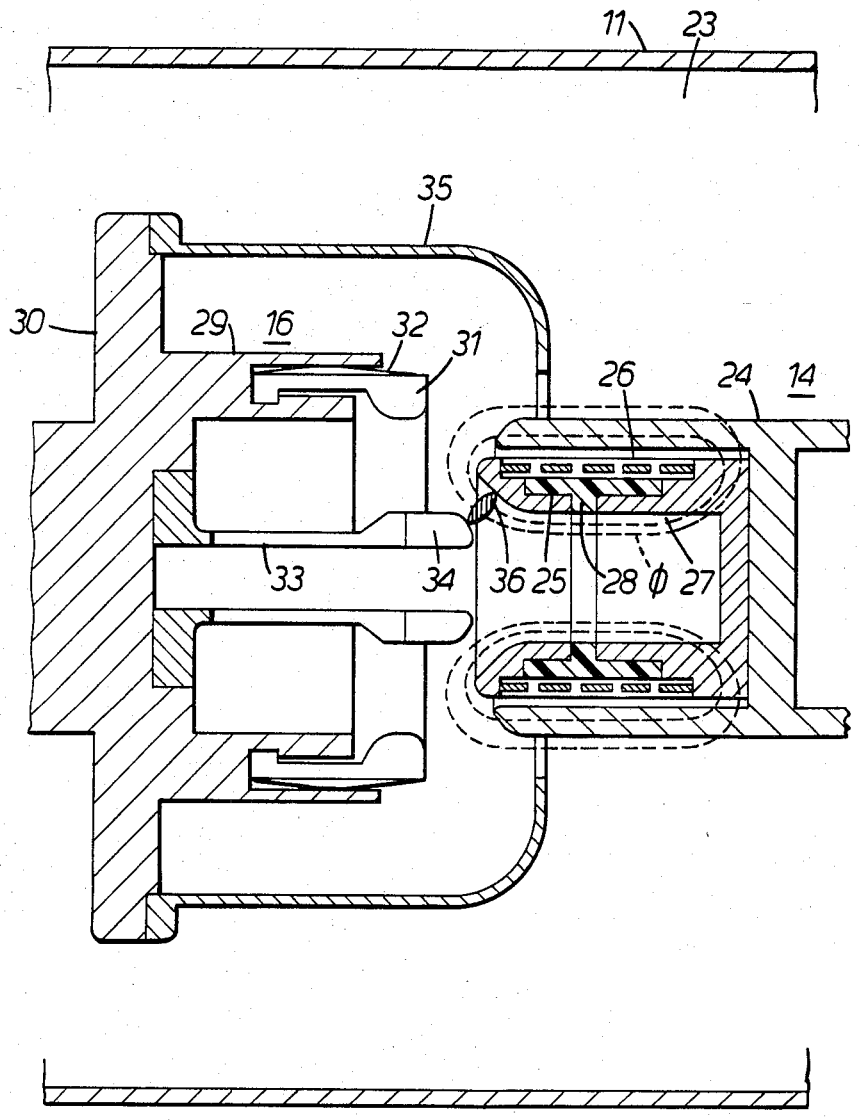
FIGS. 3 and 4 are cross-sectional views of the contact parts of the switch shown in FIG. 2 to aid in the explanation of the invention.

FIG. 3 shows the construction of a section of the contact parts. Reference numeral 11 designates a container filled with insulating gas 23. Reference numeral 14 designates the moving contact part, and reference numeral 16 designates the fixed contact part, both of these being mounted within the tank 11. The moving contact part 14 is made up of a main current-carrying contactor 24 which is cylindrical and has a dividing wall, partitioning its inner space; a ring-shaped arc-proof piece 25 placed at the head of the main current-carrying contactor 24 and arranged concentrically within the cylinder thereof; an arc drive coil 26, placed inside the main current-carrying contactor 24, and having one end coupled to the arc-proof piece 25; a cup-shaped end ring 27, placed deep within the main current-carrying contactor 24 and having an open end facing the head of the main current-carrying contactor 24 and coupling the other end of the arc drive coil 26; and an insulating cylinder 28 forming a spool for the arc drive coil 26 and having a rear end fitted to the front end of the end ring 27 and a front end fitted to the arc-proof piece 25.

The fixed contact part 16 consists of a generally cup-shaped contactor base 29 having an outer flange 30 and a head shaped like a cylinder with an open end opposite the flange 30; a cylindrical main current-carrying contactor 31 which makes contact with or separates from the outer circumference of the main current-carrying contactor 24, fixed to the head of the contactor base 29 and projecting from its open end in parallel with the axis of the contactor base 29; a spring 32 providing the main current-carrying contactor 31 with a bias force, in the direction of the central axis of the contactor base 29; an arc electrode 33, generally cylindrical in shape and disposed inside the contactor base 29 in its axial direction and concentrically with base 29 and contactor 31, with for example at least one groove cut axially in the arc electrode 33 beginning from a tip thereof, making elastic deformation possible in the direction of the central axis, or with several rod-shaped pieces forming a cylindrical shape and performing a similar function; and an arc-proof piece 34 fixed to the tip of the arc electrode 33. Like the arc electrode 33, the main current-carrying contactor 31 can also be constructed either of a grooved cylinder or of several rods formed into a cylindrical shape, so as to make elastic deformation possible. Further, a tubular shield 35 surrounds the outside of the main current-carrying contactor 31, and has a rear end part supported by the flange 30 of the contactor base 29.

In the apparatus above described, the moving contact part 14 is axially aligned and placed opposite the fixed contact part 16, and is caused to make contact with or separate therefrom by means of forward or backward axial movement of the moving contact part 14. The arc-proof piece 34 at the tip of the arc electrode 33 projects axially further outwardly than the main current-carrying contactor 31 in the direction of contact part 14, and since the ring-shaped arc-proof piece 25 on the moving contact part 14 also projects further axially outwardly in the direction of contact part 16 than the main current-carrying contactor 24, in contact-closing operation, contact takes place first between the arc electrode 33 and the ring-shaped arc-proof piece 25, after which contact is made between the main current-carrying contactors 31 and 24. In contact-openings, the reverse process takes place.

In contact-opening, the arc electrode 33 and the ring-shaped arc-proof piece 25 are the last to be separated, so an arc (36 in FIG. 3) is then generated between these two elements.

At this point, the route taken by the electric current through the moving contact part 14 is from the ring-shaped arc-proof piece 25 to the coil 26 to the end ring 27; and magnetic flux $\phi$ is produced by the coil 26.

Since the above-mentioned arc 36 is generated between the end-face of the ring-shaped arc-proof piece 25 and the end-face of the arc-proof piece 34 on the arc electrode 33 which is smaller in diameter than the ring-shaped arc-proof piece 25, it is virtually at right angles to the magnetic flux $\phi$ generated by the coil 26, and the major component of the magnetic flux $\phi$ which acts on the arc is the component normal to this arc 36. The arc 36 therefore rotates between the arc electrode 33 and the ring-shaped arc-proof piece 25 in the circumferential direction of the ring-shaped arc-proof piece 25. As the arc 36 is cooled by this phenomenon, a strong arc-extinguishing effect can thus be obtained.

It can sometimes happen, however, that when a failure occurs in a part of the transmission system a large amount of current, equivalent to the rated breaking current of the breaker, flows to this switch. The switch must retain its normal efficiency even after this kind of surge in the current has occurred.

Figure 4:
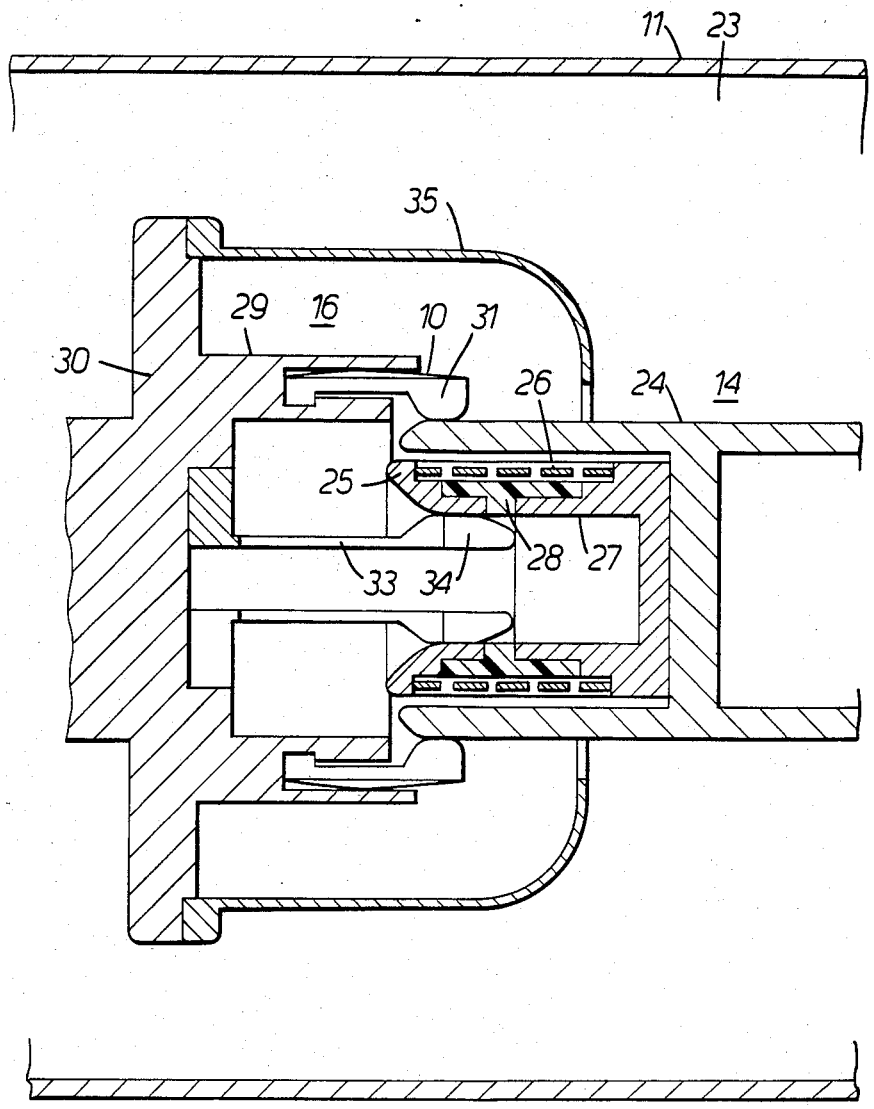

FIG. 4 shows the switch illustrated in FIG. 3, of the type in which the arc between the contacts is extinguished by rotation caused by a magnetic field, in the closed state.

As is clear from the drawing, in the closed state the main current-carrying contactors 24 and 31 meet and form a main passageway for the current; the arc-proof piece 34 on the arc electrode 33 and the ring-shaped arc-proof piece 25 also make contact, so that an electrical circuit is formed on the arc electrode 33 side linking the contactor base 29, the arc-proof piece 34, the ring-shaped arc-proof piece 25, the coil 26, the end ring 27, and the main current-carrying contactor 24.

Consequently, if a large amount of current as above-mentioned flows to the switch illustrated in FIG. 4, this current will take two routes: the route from the cylindrical main current-carrying contactor 24 via the current-carrying contactor 31 to the contactor base 29, and the route from the cylindrical main current-carrying contactor 24 via the end ring 27 of the coil 26, the coil 26, and the ring-shaped arc-proof piece 25 to the arc electrode 33, and thence to the contactor base 29. In this event, if the current is at the level of the rated current for the line, the flowing of part of the current through the coil 16 does not cause any problem. If however it is at the high level of the rated breaking value for the breaker, the coil 26 is in danger of overheating from this current, or damage may be caused by the electromagnetic force it generates.

Figure 5:
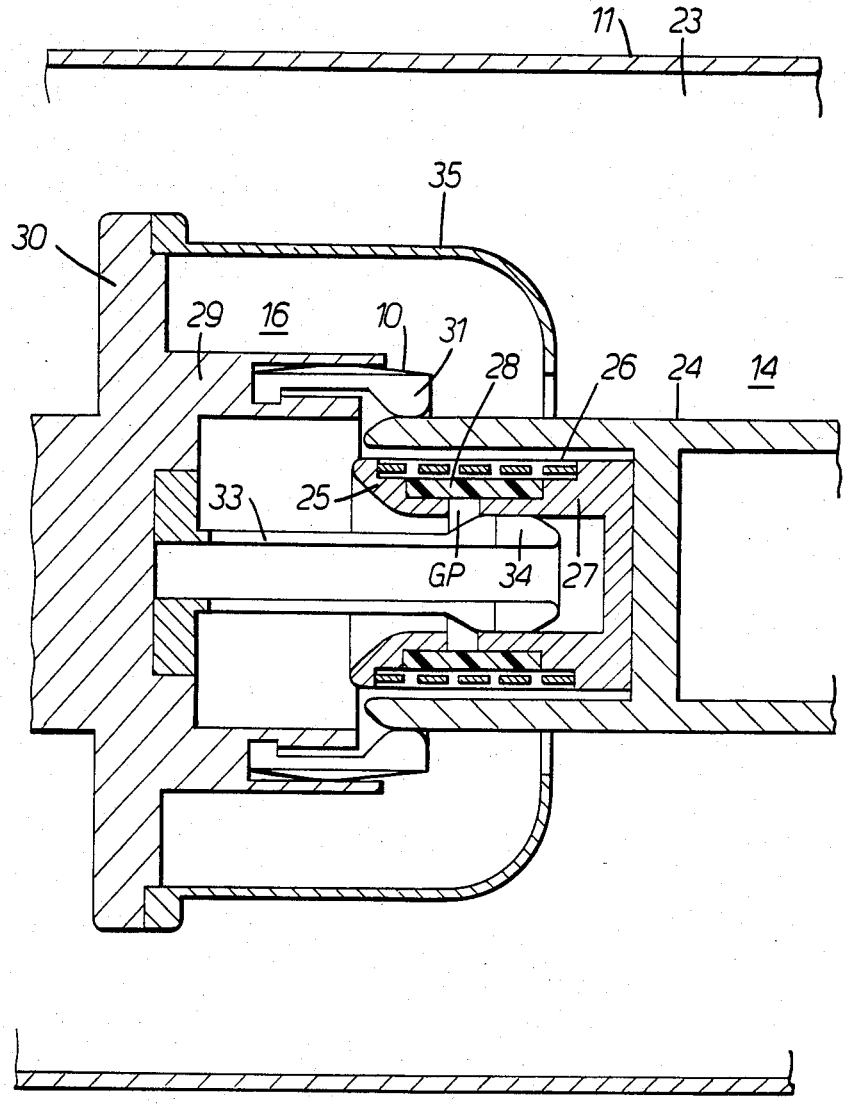
FIGS. 5 and 6 are cross-sectional views of the contact parts of another embodiment of the invention.
Figure 6:
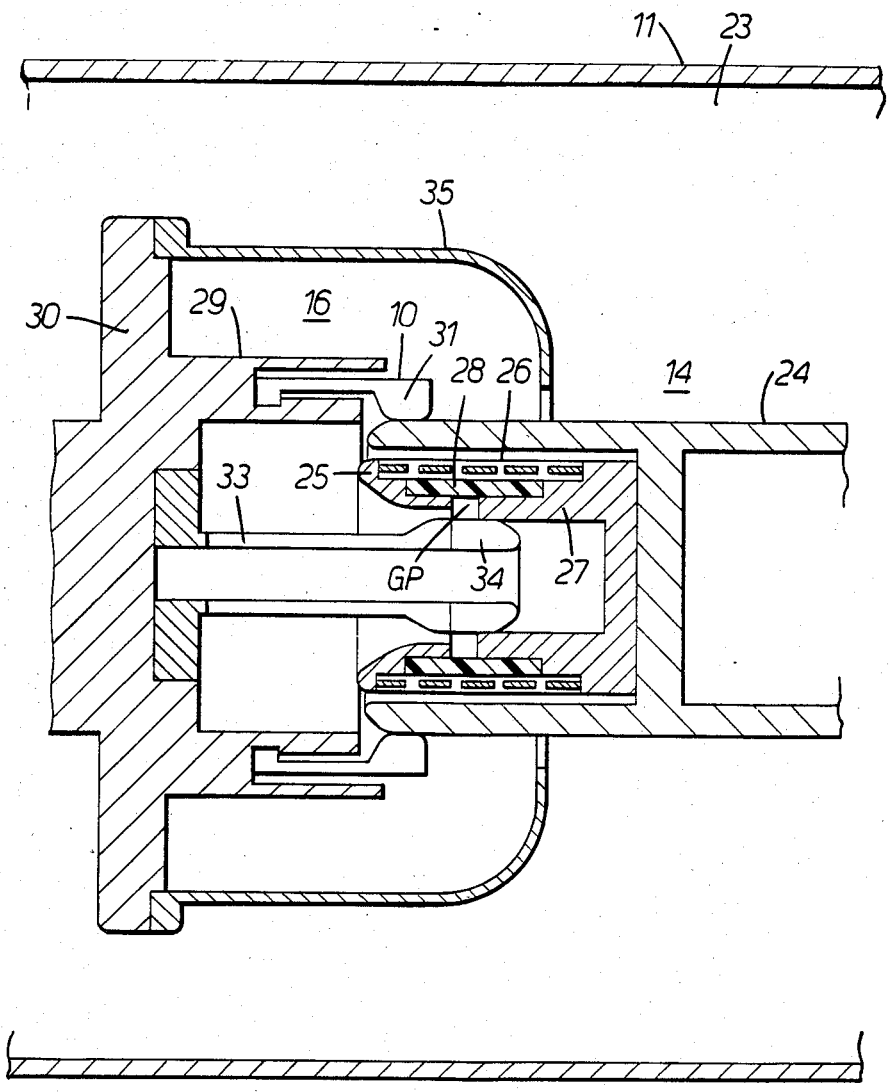

In a second embodiment of the invention as shown in FIGS. 5 and 6, in order to eliminate the possibility of overheating or damage to the coil 26 when a large amount of current flows along the route through the arc electrode side and through the coil 26 when the contacts are closed, which is a potential problem of the 1st embodiment, the gas insulated switch is so constructed that when the contacts are closed the arc-proof piece 34 on the arc electrode makes contact with the end ring 27, so the coil 26 is short-circuited and removed from the route along which the current passes.

The point is that in the structure depicted in FIG. 5, the length in the axial direction of the previously-mentioned arc electrode 33 is increased, as shown by 11*a* in FIG. 5, so that when the contacts are closed, it makes contact with the inside of the end ring 27 instead of, as in the 1st embodiment, the ring-shaped arc-proof piece 25. With this arrangement, the route for the current on the arc electrode side runs from the arc electrode 33 directly to the end ring 27, the coil 26 being thus completely isolated from the route. Consequently, even when a large amount of current flows into the switch when it is in the closed state there is no danger of the coil 26 being heated or damaged by electromagnetic force, and the breaking capability of the switch is just the same after the passage of the large amount of current as it was before it.

In the FIG. 5 apparatus, moreover, since when the contacts are opened the ring-shaped arc-proof piece 25 and the arc-proof piece 34 are the last to separate, the coil 26 enters the current path at this time, so that the previously-mentioned rotation of the arc can be effected. The same result is achieved if the construction is such that the arc electrode 33 contacts the ring-shaped arc-proof piece 25 and the coil end 27, thereby bridging the coil 26.

Further, if the apparatus is so constructed that the internal diameter of the end ring 27 of the coil 26 is made smaller than that of the ring-shaped arc-proof piece 25, as shown in FIG. 6, so that when the switch is closed the arc-proof piece 34 at the end of the arc electrode 33 will make contact only with the end ring 27, the connection with the end ring 27 will be even better than when the internal diameter of the two parts is the same.

According to this invention, a gap GP is formed between the ring-shaped arc-proof piece 25 and the end ring 27 where they are disposed opposite each other as shown from FIG. 3 to FIG. 6.

This construction takes the same effect as having a gap which is formed parallel to the coil 26.

When the disconnecting switch is opened, first of all, main current carrying contactor 24 separates from the current carrying contactor 31 and next the arc-proof piece 34 at the top the arc electrode 33 separates from the ring-shaped arc-proof piece 25 and as a result an arc is generated therebetween. The arc rotates in the circumferential direction of the ring-shaped arc-proof piece 25 and therefore the arc is cooled by this phenomenon.

The arc electrode 33 is constructed of a cylinder with grooves provided thereon, so as to suppress a magnetic flux produced by reverse magnetic field owing to eddy current, and accordingly the arc is divided smoothly so as to be cooled and the current is broken out at the time the current value is zero.

In case that a restrike of arc occurs after the current ceases the high voltage surge is generated on the coil 26. But the surge is discharged through the gap GP between the ring-shaped arc-proof piece 25 and the end ring 27 which is connected to movable contact 14 where they are disposed opposite each other. The arc is shielded by the insulation 28. The characteristic for protecting against such overvoltage depends upon the length of gap GP.

As described in detail above, the invention provides a gas insulator switch with outstanding characteristics, which is so constructed such that in a gas insulated switch which is provided with one contact part consisting of, in addition to a ring-shaped arc-proof piece and a coil having one end disposed in close proximity thereto, and an end ring connected to the opposite end of the coil, and a main current-carrying contactor on the outside of the ring-shaped arc-proof piece, the coil and the end ring, and another contact part having a main current-carrying contactor which makes contact with or separates from the previously-mentioned main current-carrying contactor and an arc electrode which makes contact with or separates from the previously-mentioned arc-proof piece; and in which, in addition to the opening and closing of a current-carrying route being effected by the bringing into contact or separating these two contact parts, an arc is generated when the contacts are opened between the previously-mentioned arc electrode and the previously-mentioned ring-shaped arc-proof piece, and the current is broken when this occurs through rotation of the arc by the magnetic flux produced in the coil by the current flowing through it. When contact is closed between the two previously-mentioned contact parts, the arc electrode of the second contact part makes contact with the opposite end of the coil in the previously-mentioned first contact part, so that even when a large amount of current flows into the switch when the circuit is closed, no current flows into the coil, and there is therefore no possibility of heating or damage to the coil, with consequently no risk of any lessening of circuit-breaking capability by virtue of damage of the coil after the passage of such a large amount of current; and which, morever, is of simple construction and possesses a breaking capability fully equal to that of conventional switches.

Obviously, numerous modifications and variations of the present invention are possible in light of the above teachings. For example, the movable and fixed parts can interchange elements, such as the coil being located in the movable part. It is therefore to be understood that within the scope of the appended claims, the invention may be practiced otherwise than as specifically described herein.

What is claimed as new and desired to be secured by Letters Patent of the United States is:

1. A gas insulated switch comprising:

a tank filled with an insulating gas;

first and second contacting parts disposed opposite each other within said tank and each including respectively first and second main current-carrying contactors and first and second arc electrodes installed respectively within said first and second main current-carrying contactors, said first and second main current-carrying contactors disposed opposite each other and adapted for relative movement therebetween such that said first and second main current-carrying contactors freely make contact with or move apart from each other, said first and second arc electrodes disposed opposite each other such that said first and second arc electrodes also freely make contact with or part from each other in accordance with the relative movement of said first and second main current-carrying contactors;

said second arc electrode defining opposite ends, and including a ring-shaped arc-proof piece arranged at one end thereof, an arc drive coil disposed adjacent to said arc-proof piece and electrically connected thereto at one end thereof, and an end ring disposed adjacent said coil and electrically connected to an opposite end thereof; and said first and second arc electrodes extending exterior of said respective first and second main current-carrying contactors and shaped such that when an electrical connection is made between said first and second arc electrodes, said first arc electrode makes contact with said end ring of said second arc electrode, and such that when said arc electrodes are opened, an arc is generated between said first arc electrode and said ring-shaped arc-proof piece of said second arc electrode producing a current in said drive coil which generates a magnetic flux acting substantially perpendicular to said arc to extinguish said arc.

2. A gas insulated switch according to claim 1, wherein said second arc electrode comprises:

an aperture forming a parallel gap between said ring-shaped arc-proof piece and said end ring.

3. A gas insulated switch according to claim 2, wherein said ring-shaped arc-proof piece and said end ring each define a respective internal diameter, and wherein the internal diameter of said ring-shaped arc-proof piece is larger than that of said end ring.

* * * * *